US009587819B2

(12) United States Patent
Geels et al.

(10) Patent No.: US 9,587,819 B2
(45) Date of Patent: Mar. 7, 2017

(54) LUMINAIRE HAVING HEAT TRANSFER DEVICE ADAPTABLE TO DIFFERENT LUMINAIRE HOUSING SHAPES AND METHOD OF ASSEMBLING THE LUMINAIRE

(71) Applicant: PHILIPS LIGHTING HOLDING B.V., Eindhoven (NL)

(72) Inventors: Marijn Geels, Eindhoven (NL); Mark Johannes Antonius Verhoeven, Deurne (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/416,286

(22) PCT Filed: Jul. 24, 2013

(86) PCT No.: PCT/IB2013/056051

§ 371 (c)(1),
(2) Date: Jan. 22, 2015

(87) PCT Pub. No.: WO2014/016775

PCT Pub. Date: Jan. 30, 2014

(65) Prior Publication Data

US 2015/0260388 A1 Sep. 17, 2015

Related U.S. Application Data

(60) Provisional application No. 61/676,397, filed on Jul. 27, 2012, provisional application No. 61/676,447, filed on Jul. 27, 2012.

(51) Int. Cl.
*F21V 29/70* (2015.01)
*F21V 29/51* (2015.01)
(Continued)

(52) U.S. Cl.
CPC ..... *F21V 29/51* (2015.01); *F21V 29/006* (2013.01); *F21V 29/503* (2015.01); *F21V 29/70* (2015.01);
(Continued)

(58) Field of Classification Search
CPC .... F21V 29/71; F21V 29/70; F21W 2131/103
See application file for complete search history.

(56) References Cited

U.S. PATENT DOCUMENTS 5,944,093 A 8/1999 Viswanath
8,123,386 B2 * 2/2012 Moshtagh ..... F21V 29/004 362/294
(Continued)

FOREIGN PATENT DOCUMENTS

CN 101760035 A 6/2010
EP 0348838 A2 1/1990
(Continued)

*Primary Examiner* — Robert May

(57) ABSTRACT

A heat transfer device for transferring heat to a housing, comprising a heat spreader, at least one heat transfer plate mechanically connected to the heat spreader so as to be resiliently compressible towards the heat spreader when brought into contact with the housing, and at least one heat pipe thermally connected to each heat transfer plate and to the heat spreader. The resilient compressibility of the heat transfer plates makes the heat transfer device flexible, such that it may adapt to a different shape of housing. In contrast to known thermal interfaces, the thermal interface of the heat transfer device of the invention is not mechanically connected to the housing in which it is used, but connected to the heat spreader, and may instead be pressed into contact with the housing, without mechanical fixation.

15 Claims, 5 Drawing Sheets

(51) Int. Cl.

| | |
|---|---|
| ***F21V 29/00*** | (2015.01) |
| ***F21V 29/503*** | (2015.01) |
| ***F28D 15/02*** | (2006.01) |
| *F21Y 101/00* | (2016.01) |

(52) U.S. Cl.
CPC ..... *F28D 15/02* (2013.01); *F21Y 2101/00* (2013.01); *Y10T 29/49826* (2015.01)

(56) References Cited

U.S. PATENT DOCUMENTS

| | | | | |
|---|---|---|---|---|
| 9,033,558 | B2 * | 5/2015 | Farmer ..... | F21S 8/086 362/365 |
| 2008/0089070 | A1 | 4/2008 | Wang | |
| 2009/0135594 | A1 | 5/2009 | Yu et al. | |
| 2010/0103667 | A1 | 4/2010 | Thrailkill | |
| 2011/0000516 | A1 | 1/2011 | Hershberger et al. | |
| 2011/0235335 | A1 | 9/2011 | Ishida et al. | |
| 2015/0233558 | A1 * | 8/2015 | Ticktin ..... | F21V 21/22 362/404 |

FOREIGN PATENT DOCUMENTS

| | | | |
|---|---|---|---|
| EP | 2296454 | A1 | 3/2011 |
| EP | 2439821 | A1 | 4/2012 |
| FR | 2889291 | A1 | 2/2007 |
| KR | 2010029301 | A | 3/2010 |
| WO | 2011007224 | A2 | 1/2011 |

* cited by examiner

LUMINAIRE HAVING HEAT TRANSFER DEVICE ADAPTABLE TO DIFFERENT LUMINAIRE HOUSING SHAPES AND METHOD OF ASSEMBLING THE LUMINAIRE

CROSS-REFERENCE TO PRIOR APPLICATIONS

This application is the U.S. National Phase application under 35 U.S.C. §371 of International Application No. PCT/IB13/056051, filed on Jul. 24, 2013, which claims the benefit of U.S. Provisional Patent Application No. 61/676,397, filed on Jul. 27, 2012 and Provisional Patent Application 61/676,447 filed on Jul. 27, 2012. These applications are hereby incorporated by reference herein.

FIELD OF THE INVENTION

The present invention relates to a heat transfer device, to a luminaire comprising a heat transfer device, and to a method of assembling a luminaire.

BACKGROUND OF THE INVENTION

In new applications of LED lighting, such as street lights and automotive lights, typically a powerful light source is used. With current LEDs, this leads to a significant heat production, in the order of hundreds of watts. This heat has to be transported away from the light source, or else the light source will deteriorate. The heat is spread over a large surface of a so called heat spreader, wherefrom it can disperse into the ambient air. The heat spreader is oftentimes made of metal and may also be referred to as a heat sink.

One possible solution to the problem of transporting heat away from the light source is to use ventilator. However, the ventilator has moving parts that may break down. Further, the use of a ventilator leads to increased costs, for manufacture as well as for energy during use.

Another solution is to use heat pipes. They typically consist of a relatively stiff metal tube with a cooling fluid inside.

Still, regardless of which of these solutions is used, problems remain. When a light engine of a luminaire is exchanged, the thermal interface system is also exchanged. It is generally not possible to modify the luminaire itself. For example, it is desirable to keep the canopy of the luminaire intact. Therefore, when the light engine is exchanged, the new thermal interface system has to be adapted to the existing luminaire. This leads to increased costs for providing different types of thermal interface systems for each light engine in order to be able to use the light engine in different luminaires.

Thus, a need remains for an improved thermal interface system, which could be used in a larger number of different luminaires.

SUMMARY OF THE INVENTION

It is an object of the present invention to overcome this problem, and to provide a heat transfer device that may be used in a wide variety of luminaires, regardless of the type of light engine used, without having to adapt the luminaire, and without having to keep different heat transfer devices for different luminaires.

According to a first aspect of the invention, this and other objects are achieved by a heat transfer device for transferring heat to a housing, which heat transfer device comprises a heat spreader, at least one heat transfer plate mechanically connected to the heat spreader so as to be resiliently compressible towards the heat spreader when brought into contact with the housing, and at least one heat pipe thermally connected to each heat transfer plate and to the heat spreader, so that, when the heat transfer plate is brought into contact with the housing, heat is transferred from the heat spreader to the housing.

In contrast to known thermal interfaces, the thermal interface of the heat transfer device of the invention is not mechanically connected to the housing in which it is used, but connected to the heat spreader, and may instead be pressed into contact with the housing, without mechanical fixation. The resilient compressibility of the heat transfer plates makes the heat transfer device flexible, such that it may adapt to a different shape of housing.

A light engine, e.g. a LED module, may be attached to the heat spreader. When the light engine and the heat transfer device are mounted in a luminaire, the heat transfer plate of the heat transfer device may be placed in contact with a housing of the luminaire, in order to transfer heat from the light engine to the housing, wherefrom it may diffuse into the ambient air. When exchanging the light engine of a luminaire, the new light engine may simply be connected to the heat spreader.

The device may comprise at least one resilient element arranged between each heat transfer plate and the heat spreader, respectively. The resilient element may, e.g., be a spring. Such a resilient element allows the heat transfer plate may be displaced in relation to the heat spreader when the heat transfer device is mounted in a luminaire.

The heat transfer plate may be flexible, e.g. by being made of a flexible material, thereby making it more adaptable to different shapes of housings.

Each heat transfer plate may be attached to an end of a heat conducting tube in which one of the heat pipes is slidably arranged. The slidable arrangement of the heat pipe in the heat conducting tube makes it possible for this heat conducting subassembly to expand and contract in length in order to adapt to different sizes of space inside the luminaire in which the heat transfer device is mounted. In this case, the resilient element may be arranged between each heat conducting tube and the heat spreader.

According to an embodiment, the heat conducting subassembly further comprises an outer tube at least partly surrounding the heat pipe and the heat conducting tube. The outer pipe may be made of a material chosen to provide stiffening to the heat pipe and the heat conducting tube, thereby making the heat transfer device more robust.

The heat pipe may be flexible. As used herein, the term "flexible heat pipe" means any heat pipe that has such a flexibility that a distance between the ends of the heat pipes may be varied. Thus, a "flexible heat pipe" may be ductile, or pliable, such that it may be bent, or elastic, or extendible, such that it may be varied in length. The heat pipe may be chosen from the group consisting of bent heat pipes, flat micro heat transmitters and spiral heat pipes.

In an embodiment, the heat spreader comprises at least one groove adapted to receive the at least one heat pipe. This is a mechanically simple way of attaching the heat pipe to the heat spreader.

According to a second aspect of the invention, this and other objects are achieved by a luminaire comprising housing, a light source, and a heat transfer device according to the first aspect of the invention. The light source is connected to the heat spreader and the at least one heat transfer plate is resiliently pressed into thermal contact with the housing.

In such a luminaire, the light source may easily be exchanged, without a need for also exchanging the thermal interface between the light source and the housing. The flexible properties of the heat spreader device make it possible for the heat spreader to adapt to the inside surface of the housing. Therefore, the heat transfer plate need not be given a shape that conforms to the profile of the inside surface of the housing. Instead, if necessary, several heat transfer devices may be used, each flexing to a degree required to adapt to the shape of the inside surface of the housing. Thereby, the same design of heat transfer device may be used for different luminaires. Further, even if one or more heat transfer devices are attached beforehand to a heat spreader having a light engine attached, the combined light engine and heat transfer device may be used for several different luminaires.

According to a third aspect of the invention, this and other objects are achieved by a method of assembling a luminaire, comprising opening the luminaire housing, connecting a light source to the heat spreader of a heat transfer device according to the first aspect of the invention, inserting the heat transfer device into the housing, such that the heat transfer plate thermally contacts an inside surface of the housing, and closing the housing, with the heat transfer device being pressed against the inside surface of the housing.

This method simplifies exchanging the light source of the luminaire, since the light source may be exchanged without also exchanging the thermal interface. By this method, in contrast to known thermal interfaces, the thermal interface of the heat transfer device of the invention is not mechanically connected to the luminaire in which it is used, but connected to the heat spreader, and instead pressed into contact with the luminaire, without mechanical fixation.

It is noted that the invention relates to all possible combinations of features recited in the claims.

BRIEF DESCRIPTION OF THE DRAWINGS

These and other aspects of the present invention will now be described in more detail, with reference to the appended drawings showing embodiment(s) of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and to fully convey the scope of the invention to the skilled person.

Figure 1:
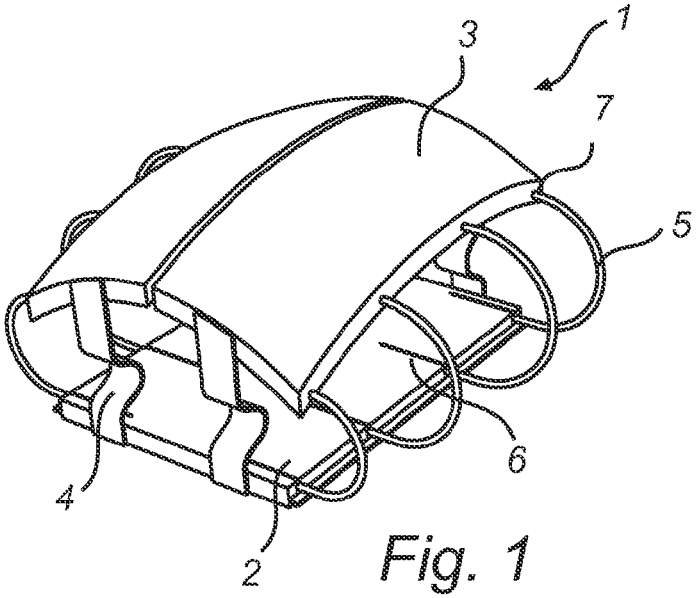
FIG. 1 is a perspective view from above of a heat transfer device according to an embodiment of the present invention.
Figure 2:
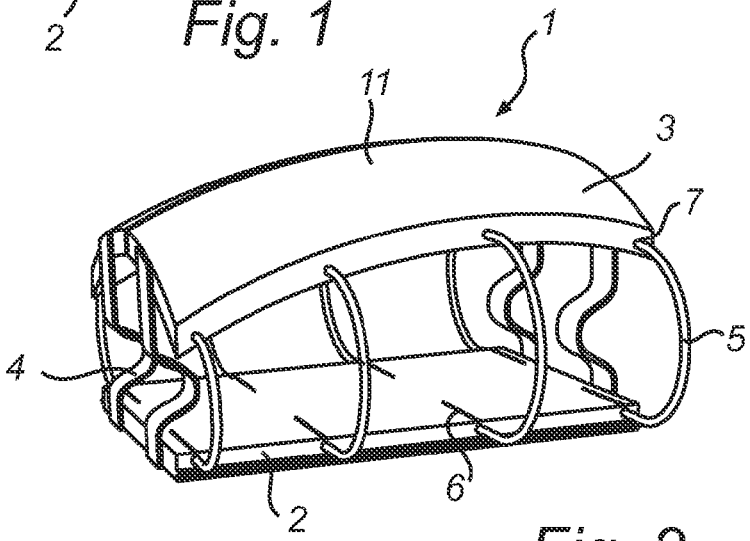
FIG. 2 is a perspective side view of the heat transfer device of FIG. 1.
Figure 3:
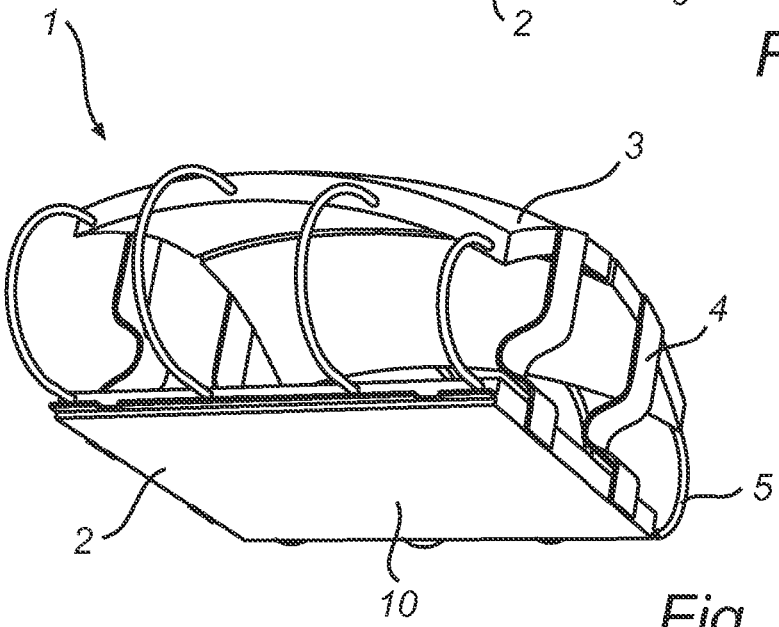
FIG. 3 is a perspective view from below of the heat transfer device of FIG. 1.

FIGS. 1-3 show a heat transfer device generally indicated with the reference numeral 1. The heat transfer device 1 includes a heat spreader 2, which is a so-called level two contact block, in this embodiment made of aluminium. The heat transfer device 1 further includes a heat transfer plate 3, which is a so-called level one contact block, here also made of aluminium. The heat spreader 2 is mechanically connected to the heat transfer plate 3, here by four resilient elements in the form of springs 4. Further, the heat spreader 2 is thermally connected to the heat transfer plate by at least one, here eight, heat pipes 5. Each spring 4 is at a first end attached to the heat spreader 2, and at a second end attached to the heat transfer plate. Thereby, a mechanical connection is formed between the heat spreader 2 and the heat transfer plate 3. The heat pipes 5 are at a first end attached to the heat spreader by insertion into grooves 6 formed in the heat spreader 2, and at a second end attached to the heat transfer plate 3 by insertion into holes 7 in the heat transfer plate 3. Thereby, a thermal connection is formed between the heat spreader 2 and the heat transfer plate 3.

The heat pipes 5 may be flexible, such that they may bend, allowing a distance between the heat spreader 2, and the heat transfer plate 3 to be varied.

Figure 4:
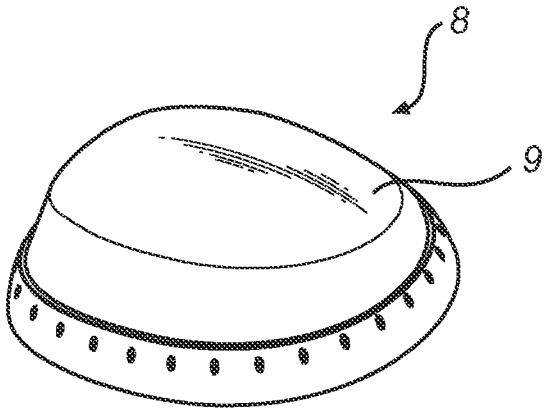
FIG. 4 is a perspective view of an embodiment of a luminaire having a heat transfer device of the type shown in FIG. 1.
Figure 5:
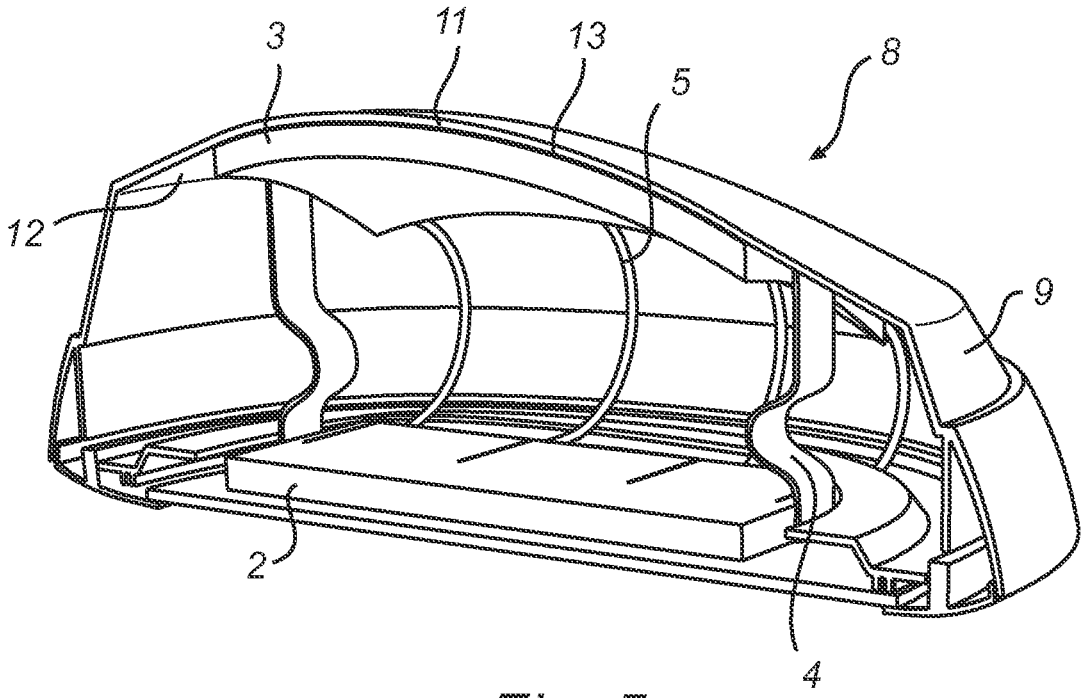
FIG. 5 is a cross sectional view of the luminaire of FIG. 4.

FIGS. 4 and 5 show the heat transfer device mounted in a luminaire, in this embodiment a street light 8 having a canopy 9, which is part of the housing of this luminaire. When exchanging an existing light engine of the luminaire 8, the new light engine, e.g., a LED module (not shown), is attached to the underside of the heat spreader 2. The heat transfer device 1, with the LED module attached, is then pushed into the canopy 9, such that the upper side 11 of the heat transfer plate 3 comes into close contact with the inside 12 of the canopy 9. In this way a thermal interface is established between the LED module and the canopy 9, such that heat produced by the LED module is spread throughout the heat spreader 2, conducted from the heat spreader via the heat pipes 5, and to a lesser degree via the springs 4, to the heat transfer plate 3, and further to the canopy 9. The heat spreads throughout the canopy 9 and may dissipate into the ambient air.

The resilient elements 4 and the bent heat pipes 5 make it possible for the heat transfer device 1 to adapt to different sizes of light engines. If a larger light engine is used and attached to the heat spreader 2, the springs 4 and the heat pipes 5 will be more compressed such that the heat transfer device 1 still fits inside the luminaire 8, and if a smaller light engine is used, the springs 4 and the heat pipes 5 will be less compressed, such that the heat transfer device takes up more of the space inside the luminaire.

As may be seen from, e.g., FIG. 5, the heat transfer plate 3 has a shape that conforms well to the shape of the inside 12 of the canopy 9. This leads to a good thermal contact between the heat transfer plate and the canopy. On the downside, it means that the heat transfer plate 3 will have to be manufactured with a different shape for more or less each shape of canopy of the different luminaires in which it is to be used. However, if a slightly flexible material, such as aluminium, is used for the heat transfer plate 3, it may to some extent adapt to different shapes of the canopy 9 in question. The adaptability may be further increased if a flexible, thermally conductive pad 13 is attached to the upper side 11 of the heat transfer plate 3. The pad may be made of a heat conductive material. Hereby, heat transfer from a light source of a luminaire to the ambient air, via a housing of the luminaire may be enhanced.

When the heat transfer device 1 is inserted in the luminaire, the heat transfer plate 3 will, in such case, be in thermal contact with the canopy via the pad 13. Such a pad 13 may be made of a thermal interface material (TIM), and may be used to advantage even if the upper side 11 of the heat transfer plate 3 conforms well to the inside 12 of the canopy 9. The pad need not cover the entire upper side 11 of the heat transfer plate 3, but could extend over only part of the upper side 11.

The other components of the heat transfer device 1, i.e. the heat spreader 2, the springs 4, and the heat pipes 5, may be the same regardless of the shape of the canopy, such that this sub-assembly may be identical in all heat transfer devices, and only the heat transfer plate 3 needs to be shaped differently for different luminaires. Naturally, if desired, different sizes of the heat spreader 2 may be chosen for different luminaires. Similarly, the lengths of the springs 4 and the heat pipes 5 may be chosen differently for different luminaires.

It should be noted that the heat transfer device 1 is an independent part, which is not mechanically attached to the luminaire 8, which is otherwise normally the case.

Figure 6:
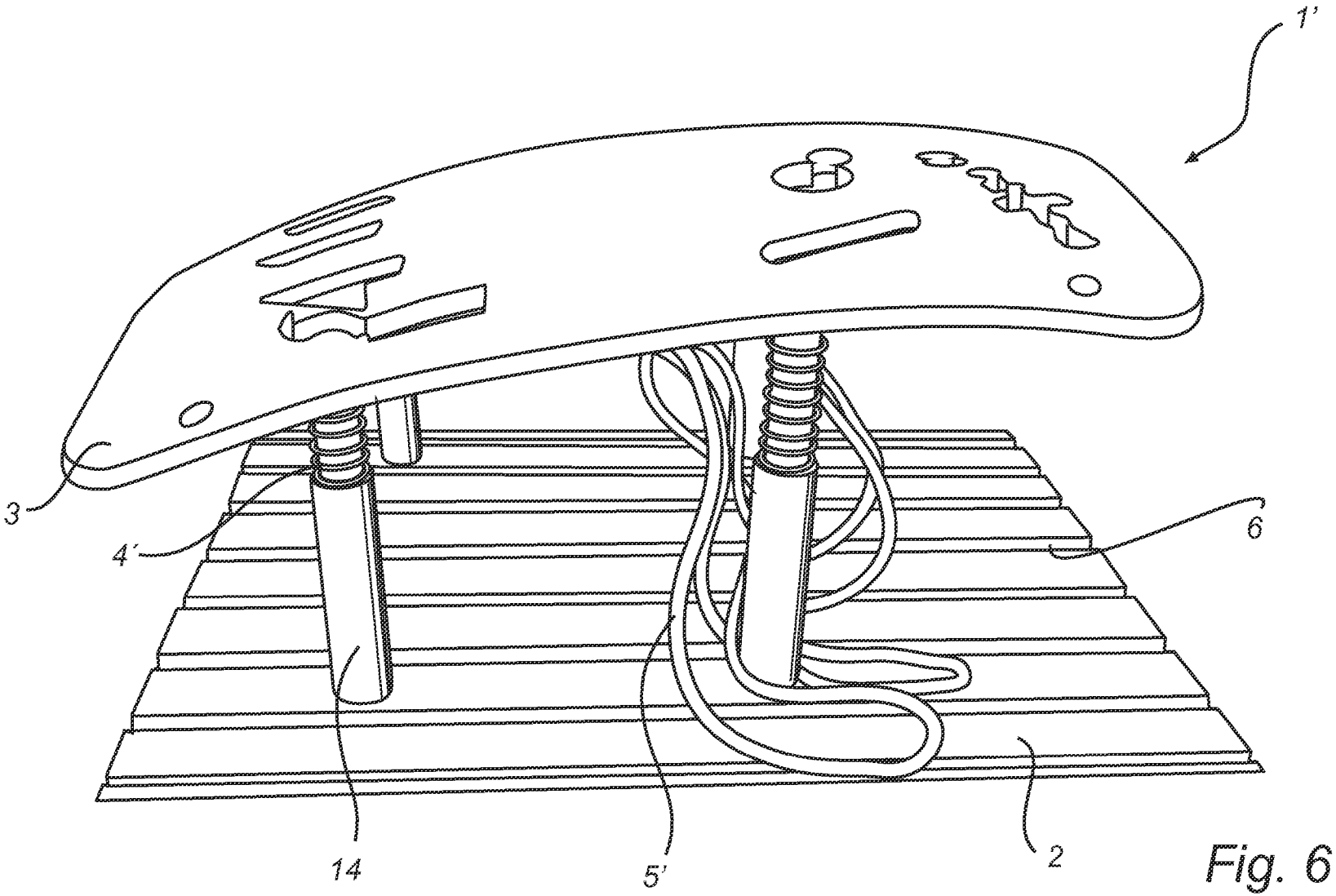
FIG. 6 is a perspective side view of a heat transfer device according to a farther embodiment of the present invention.

FIG. 6 shows another embodiment of a heat transfer device 1' of the invention. This embodiment is similar to the one shown in FIGS. 1-5, and like parts are marked with like reference numerals. Only the differences will be discussed here. The resilient elements in the form of springs 4' used in this embodiment here cooperate with guiding pins or tubes 14, thereby making the heat transfer device 1' more resistant to sideways deformation. The heat pipes 5' used in this embodiment of the heat transfer device 1' are spiral shaped heat pipes 5'. These heat pipes may also provide a spring function.

Figure 7:
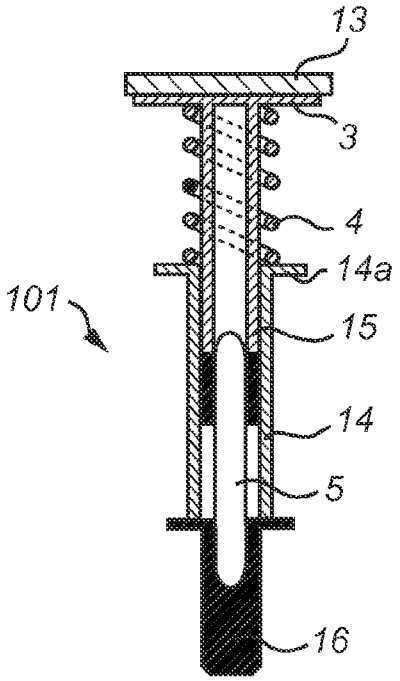
FIG. 7 is a cross-sectional view of a heat transfer device according to a further embodiment of the invention.

FIG. 7 shows, in cross-section, a compressible, heat conducting sub-assembly 101 of a compressible heat transfer device 1 according to a further embodiment of the invention. The sub-assembly 101 here has an attachment means 16 in the form of a bushing made of copper or aluminium, adapted to be fixedly mounted to a heat spreader (not shown). The choice of material may be made to provide good heat conducting properties, light weight and/or good machining properties.

In the bushing 16, a heat pipe 5 is inserted. The heat pipe 5 is slidably arranged inside a heat conducting tube 15 made of e.g. stainless steel. An outer tube 14, also made of e.g. stainless steel, is arranged concentrically on the outside of the heat conducting tube 15. The outer tube 14 is stiff enough to stabilise or reinforce the heat pipe 5 and the heat conducting tube 15, such that they do not bend from the forces involved when mounting the heat transfer device 1 in a luminaire. At one end, the outer tube 14 is fixedly attached to the attachment means 16, and at the other end it is provided with a radially outwardly extending flange **14*a*. A resilient element in the form of a helical spring 4 is arranged on the outside of the heat conducting tube 15, surrounding the heat conducting tube 15. At one end, the spring 4 abuts the flange 14*a* of the outer tube 14. At the other end, the spring 4 abuts a heat transfer plate 3 attached to the end of the heat conducting tube 15. The heat transfer plate 3 can be made of copper or stainless steel, and may be thin enough to be fairly flexible. A pad 13 made of thermal interface material can be attached to the heat transfer plate 3, on the surface facing away from the heat conducting pipe 15**.

Figure 8:
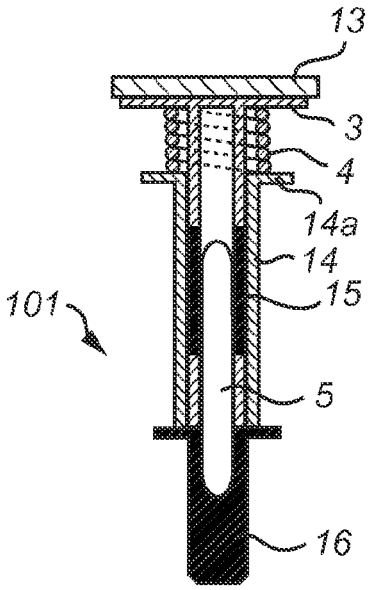
FIG. 8 is a cross-sectional view showing the heat transfer device of FIG. 7 in a compressed state.

FIG. 7 shows the compressible sub-assembly 101 in its full length, i.e. in a state where the spring 4 is not compressed. Turning to FIG. 8, this shows the compressible sub-assembly 101 in a compressed state, i.e. in a state where the heat transfer plate 3 is pushed down closer to the attachment means 16, thereby compressing the spring 4. These two figures show the two extreme states of the sub-assembly 101. Naturally, the sub-assembly 101 may be compressed to any intermediate state there between, as needed.

Figure 9:
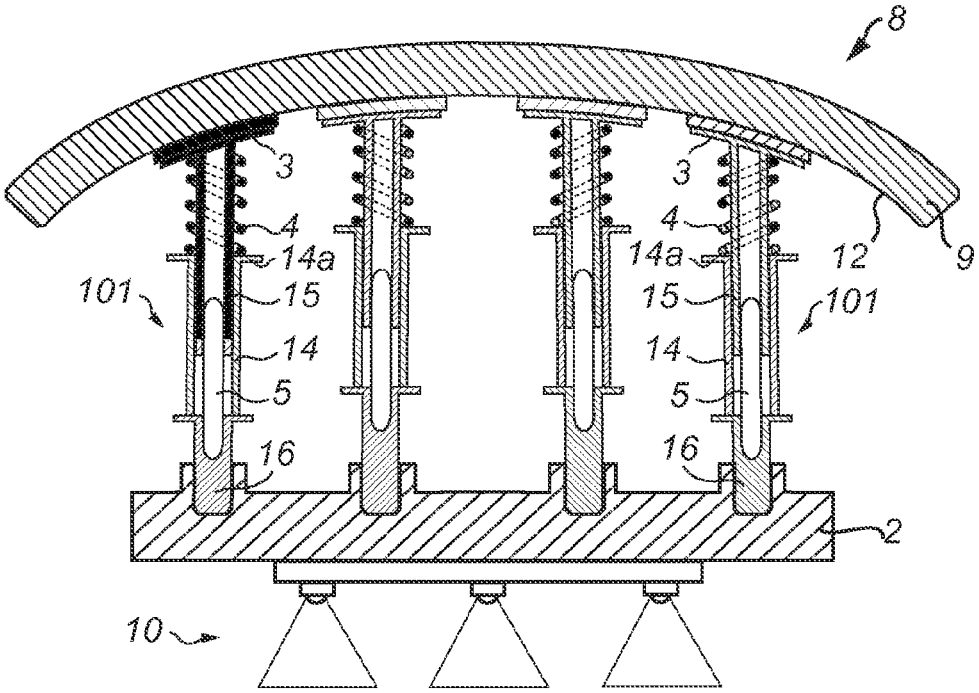
FIG. 9 is a cross-sectional view of a luminaire provided with a heat transfer device of the type shown in FIG. 1, with four heat pipes.

FIG. 9 shows a cross section through part of a luminaire 8, similar to that in FIG. 4-5, provided with a heat transfer device 1 with four compressible sub-assemblies 101.

Figure 10:
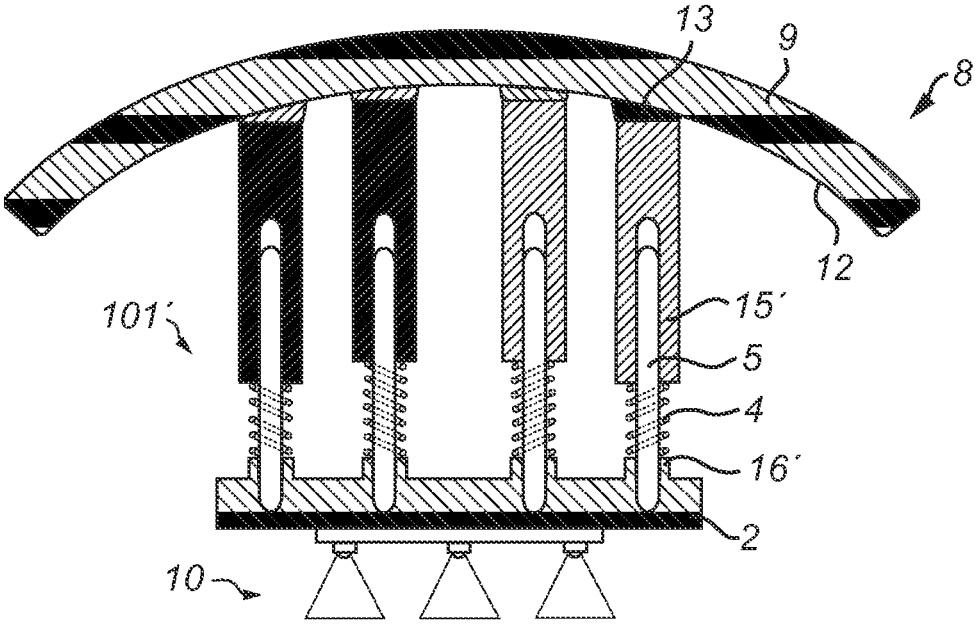
FIG. 10 is a cross-sectional view of a luminaire provided with a heat transfer device according to yet another embodiment of the present invention.

FIG. 10 shows a cross section through part of a luminaire 8 provided with a heat transfer device 1 having four compressible sub-assemblies 101' according to a different embodiment. This embodiment is similar to the one shown in FIG. 9, and like parts are indicated with like numerals. Only the differences will be discussed here. The attachment means 16' for attachment of the heat pipes 3 are here integrally formed with the heat spreader 2. Thus, differing from the previous embodiment, the attachment means 16' are here not separate components, but part of the heat spreader 2. The heat pipes 5 may be fixedly attached to the attachment means 16' by soldering, clamping or gluing. If a separate attachment means 16 is used, such as in FIG. 9, the attachment means 16 may be fixedly attached to the heat spreader 2 in the same way.

The sub-assembly 101' of this embodiment does not have any outer tubes. Instead, the resilient element 4 is arranged between the heat spreader 2 and the lower end of the heat conducting tube 15'. The heat transfer plate 3' is in this embodiment not a separate part, but an integrated part of the heat conducting tube 15'. Here, the heat conducting tube 15' is shown without a flange for abutment of the spring 4, but the heat conducting tube 15' could be provided with a flange similar to the one on the outer tube 14 in FIG. 7. In the same way as with the heat transfer device 1 of FIG. 7, the sub-assembly 101' in FIG. 10 may be compressed by the heat pipe sliding inside the heat conducting tube 15' and by compressing the spring 4. All in all, this embodiment includes fewer separate components than the embodiment shown in FIG. 9. However, the absence of a stiff outer tube places higher requirements on the heat pipe 5 and the heat conducting tube 15' to withstand forces involved when assembling the luminaire, such that the heat pipe 5 and the heat conducting tube 15' are not bent.

Figure 11:
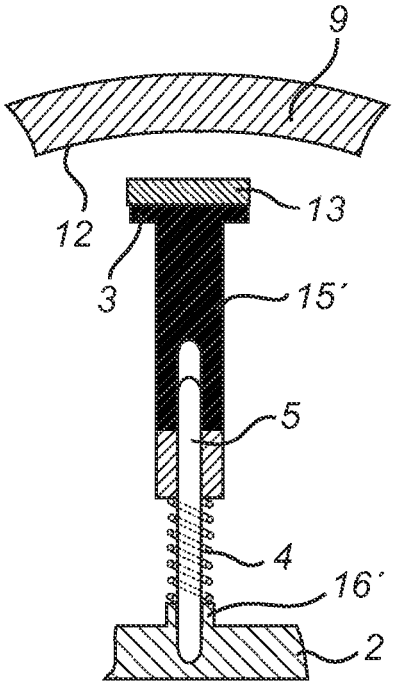
FIG. 11 is a cross-sectional view showing a step in a method of assembling the luminaire of FIG. 10.
Figure 12:
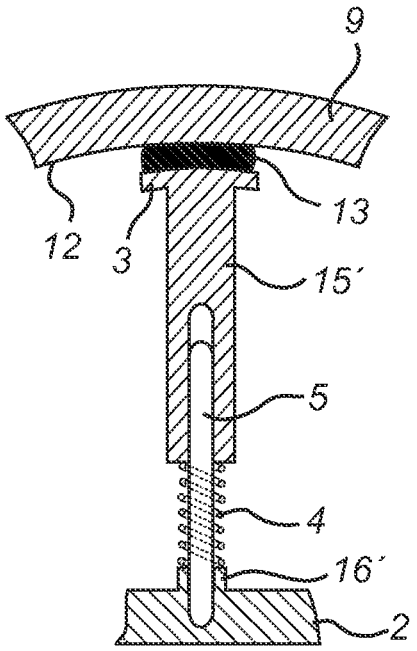
FIG. 12 is a cross-sectional view showing a later step in the method of assembling the luminaire of FIG. 10.

FIGS. 11 and 12 show how the luminaire 8 in FIG. 10 is assembled. It should be noted that the luminaires 8 in FIGS. 4, 5 and 9 may be assembled in the same way. First, a LED module 10 is attached to the heat spreader 2 of the heat transfer device 1, which heat spreader 2 is provided with at least one, here four, compressible, heat-conducting sub-assemblies 101'. The heat transfer device with the LED module 10 is inserted in the housing of the luminaire 8 until the heat transfer plate 3 contacts an inside surface 12 of the canopy 9. When the heat spreader 2 is pushed further towards the canopy 9, the heat pipe 5 slides deeper into the heat conducting tube 15' and the spring 4 is compressed until the heat spreader 2 has reached a position in which it may be locked in place inside the canopy 9. The flexibility of the heat transfer plate 3 allows the heat transfer plate to deform, such that it adapts to the profile of the inside surface 12 of the canopy 9.

The heat transfer plate 3 may be given a small size, in order to make it possible to more easily adapt to an irregular inside surface 12 of the canopy 11. Resilient elements 4 located in different positions in the luminaire 8 may be compressed to different degrees, thereby adapting to the profile of the inside surface 12 of the canopy 11. The number of resiliently arranged heat transfer plates 3 may be chosen depending on the heat transfer requirements in the luminaire in question. If a particular luminaire has a profile of the inside surface 12 of the housing which does not allow space for all heat transfer plates 3 arranged on the on the heat spreader 2, then one or several of the heat transfer plates 3 could be removed, leaving a smaller number of heat transfer plates 3 on the heat spreader 2.

In summary, the invention provides a heat transfer device which is easily adaptable to different luminaires, and which may be used regardless of which light engine is used in the luminaire. It is particularly useful for exchanging the light engine of an existing luminaire for another light engine. The heat transfer device 1 relies only on passive heat transfer, and does not require any moving parts. The heat transfer device is easily adaptable to luminaires having an irregular inside surface of the housing.

The person skilled in the art realizes that the present invention by no means is limited to the preferred embodiments described above. On the contrary, many modifications and variations are possible within the scope of the appended claims. For example, the heat pipes may be of other types providing the necessary flexibility. For instance, instead of bent standard heat pipes or spiral shaped heat pipes, they may be flat micro heat transmitters. Also, although reference has here been made to a street lamp, the invention is applicable also to other types of luminaires, particularly for outdoor use, such as automotive lights.

In the embodiments shown, resilient elements in the form of specific types of springs have been used for providing resilience to the heat transfer device. However, other resilient elements may be used instead, such as other types of springs, or elastomeric sleeves. In the embodiments shown, a helical spring surrounding the heat conducting tube is used for providing resilience to the heat transfer device.

The heat transfer device of the invention may advantageously be used when replacing a HID light module in a luminaire by a LED light module. It may also be used when replacing other kinds of light modules, such as replacing one type of LED light module by another type of LED light module.

The heat spreader and the heat transfer plate need not necessarily be made of aluminium. The skilled person will be able to make a suitable choice of material, weighing the need of thermal conduction properties with a desirable flexibility and possibly light weight.

The heat pipes may be connected to the heat spreader in other ways, e.g., using gluing, soldering, or threaded engagement. Analogously, the heat pipes may be connected to the heat transfer plate in other ways, such as by grooves, or by gluing, soldering, or threaded engagement.

Further, features of the various embodiments shown may very well be combined, for instance using an attachment means integrated in the heat spreader as in FIG. 10, while in all other respects constructing the sub-assembly in accordance with the embodiment shown in FIG. 9, i.e. using an outer tube.

The number and lengths of springs and heat pipes may be chosen differently. If spiral shaped heat pipes are used, possibly a heat pipe could also fill the function of a resilient element.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A luminaire comprising:
- a luminaire housing,
- a light source, and
- a heat transfer device for transferring heat from the light source to the luminaire housing, said heat transfer device comprising:
  - a heat spreader,
  - at least one heat transfer plate mechanically connected to said heat spreader through a spring and resiliently compressible towards said heat spreader when brought into contact with said luminaire housing, such that the at least one heat transfer plate is adaptable to different luminaire housing shapes, and
  - at least one heat pipe thermally connected to the at least one heat transfer plate and to said heat spreader,
  - wherein heat is transferred from said light source to said luminaire housing as a result of said light source being connected to the heat spreader and the heat transfer plate resiliently pressed into thermal contact with said luminaire housing.

2. The luminaire according to claim 1, wherein said at least one heat transfer plate is flexible.

3. The luminaire according to claim 1, wherein said heat pipe is made of copper.

4. The luminaire according to claim 1, wherein said heat pipe is flexible.

5. The luminaire according to claim 1, wherein said heat pipe is chosen from the group consisting of bent heat pipes, flat micro heat transmitters and spiral heat pipes.

6. The luminaire according to claim 1, wherein said heat spreader comprises at least one groove adapted to receive said at least one heat pipe.

7. A luminaire comprising:
- a luminaire housing,
- a light source, and
- a heat transfer device for transferring heat from the light source to the luminaire housing, said heat transfer device comprising:
  - a heat spreader,
  - at least one heat transfer plate mechanically connected to said heat spreader so as to be resiliently compressible towards said heat spreader when brought into contact with said luminaire housing, such that the at least one heat transfer plate is adaptable to different shapes of luminaire housing, and
  - at least one heat pipe thermally connected to each heat transfer plate and to said heat spreader, wherein heat is transferred from said light source to said luminaire housing as a result of said light source connected to the heat spreader and the heat transfer plate resiliently pressed into thermal contact with said luminaire housing, and wherein the heat transfer device further comprises at least one heat conducting sub-assembly including a heat conducting tube, an end of the heat conducting tube being attached to the heat transfer plate and the heat pipe is slidably arranged in the heat conducting tube.

8. The luminaire according to claim 7, wherein said heat transfer device sub-assembly further comprises an outer tube at least partly surrounding the heat conducting tube, said outer tube being attached to the heat spreader.

9. The luminaire according to claim 7, wherein said heat transfer device sub-assembly further comprises a resilient element arranged between each heat conducting tube and said heat spreader.

10. A method of assembling a luminaire, the method comprising:

providing a luminaire housing, providing a heat transfer device comprising a heat spreader, at least one heat transfer plate mechanically connected to said heat spreader through a spring and resiliently compressible towards said heat spreader when brought into contact with said luminaire housing, such that the at least one heat transfer plate is adaptable to different luminaire housing shapes, and at least one heat pipe thermally connected to the at least one heat transfer plate and to said heat spreader, opening said luminaire housing, connecting a light source to the heat spreader of said heat transfer device, inserting said heat transfer device with said light source attached thereon into said luminaire housing, such that said heat transfer plate thermally contacts an inside surface of said luminaire housing, and adapts to the inside surface of the luminaire housing, and closing said luminaire housing, said heat transfer device being pressed against the inside surface of the luminaire housing.

11. A heat transfer device, comprising:

a heat spreader thermally coupled to a light source;

a heat transfer plate mechanically coupled to the heat spreader and resiliently compressible towards the heat spreader when the heat transfer plate is brought into contact with a luminaire housing, such that the heat transfer plate is adaptable to different luminaire housing shapes;

a heat pipe thermally coupled to the heat transfer plate and to the heat spreader; and a resilient element mechanically coupled between the heat spreader and the heat transfer plate such that the heat transfer plate is resiliently compressible towards the heat spreader, wherein the resilient element comprises a spring.

12. The heat transfer device of claim 11, wherein the heat transfer plate is flexible.

13. The heat transfer device of claim 11, wherein the heat pipe comprises copper.

14. The heat transfer device of claim 11, wherein the heat pipe is selected from the group consisting of a bent heat pipe, a flat micro heat transmitter, and a spiral heat pipe.

15. The heat transfer device of claim 11, wherein the heat spreader comprises at least one groove adapted to receive the heat pipe.

* * * * *